United States Patent [19]

Allan

[11] Patent Number: 4,484,980

[45] Date of Patent: Nov. 27, 1984

[54] PROCESS FOR BLEACHING PAPER PULP USING CAFFEINE OR GUANINE AS A VISCOSITY STABILIZERS

[75] Inventor: G. Graham Allan, Seattle, Wash.

[73] Assignee: Melamine Chemicals, Inc., Donaldsonville, La.

[21] Appl. No.: 537,889

[22] Filed: Sep. 30, 1983

[51] Int. Cl.[3] ..... D21C 9/12; D21C 9/14

[52] U.S. Cl. ..... 162/73; 162/72; 162/87; 162/88; 162/89

[58] Field of Search ..... 162/72, 76, 87, 88, 162/89, 66, 67, 73; 8/156, 108 A, 108 R

[56] References Cited

U.S. PATENT DOCUMENTS 3,308,012 3/1967 Tobar ..... 162/73

4,295,928 10/1981 Breslin ..... 162/72

*Primary Examiner*—Steve Alvo

*Attorney, Agent, or Firm*—Mary E. Picken

[57] ABSTRACT

A process for maintaining pulp viscosity during the bleaching stage or stages of pulp preparation in the manufacture of paper comprising adding an effective amount of caffeine or guanine prior to or during the bleaching stage. One example adds caffeine or guanine to one bleach stage of a chlorine bleaching sequence.

6 Claims, No Drawings

PROCESS FOR BLEACHING PAPER PULP USING CAFFEINE OR GUANINE AS A VISCOSITY STABILIZERS

Paper is made from wood pulp obtained from trees which undergoes a series of treatments. These treatments are described in various sources, among which the most useful is Casey, *Pulp and Paper Chemistry and Chemical Technology,* published by John Wiley and Sons, 1980. The *Kirk-Othmer Encyclopedia of Chemical Technology,* also published by John Wiley, second and third editions, is also a useful reference.

Logs are first cut into small sections and then into chips. The chips are digested to form paper pulp by a variety of processes. The pulping stage may be a thermo-mechanical, a semi-mechanical, or a chemical operation. In the chemical processes, the wood chips are cooked in a closed digester tank filled with either a solution of a bisulfite salt (sulfite process), caustic soda and sodium sulfide (sulfate or kraft process) or in caustic soda solution (soda process) to dissolve the materials which hold the cellulose or paper-making fibers. After completion of the pulping process the pulp is bleached.

In one typical bleaching sequence the wood pulp is bleached with chlorine in solution (C stage), extracted with alkali (E stage) and then treated with chlorine dioxide (D stage). Another typical bleaching sequence requires: chlorination (C stage), alkali extraction (E stage) and two hypochlorite bleachings (H stage). This second sequence is written as C-E-H-H where washing between the stages is indicated by a hyphen (Casey, page 669). After bleaching, these as yet unmodified cellulose fibers next undergo a stock preparation or refining step in either a batch beater or a continuous refining procedure. The wet mass of fibers is then formed into a sheet and dried.

In the bleaching steps competing factors are balanced. The brightness of the pulp is increased while maintaining pulp viscosity at acceptable levels. During bleaching lignin removal must occur without excessive cellulose degradation.

Various additives have been used in the bleaching steps to maintain higher viscosities without interfering with lignin removal. Sulfamic acid at 1 to 5 pounds per ton of pine kraft pulp resulted in good viscosities when used in the chlorination stage (Aldrich, TAPPI, March, 1968, Volume 51, 3,71A). It is also known that the drop in viscosity during the chlorination stage can be decreased by adding chlorine dioxide (Fredericks, TAPPI, January, 1971, Volume 54, 1,87). In another study, sulfamic acid was effective in the hypochlorite stage on bamboo pulp obtained by the sulfate process (Jangalgi, IPPTA, January, 1971, Volume 8, 1,11). However, sulfamic acid, a white crystalline powder, has corrosive properties which can produce skin inflammation or blindness if permitted to enter the eye (Hernadi, Zellstoff und Papier 1975/5 p 147–149). A need for a replacement for sulfamic acid as viscosity stabilizer in bleaching is apparent.

It has been found that compounds having nitrogen atoms in their ring structures also act as viscosity stabilizers in the bleaching of pulp. Among these nitrogen containing compounds are caffeine and guanine. Caffeine and guanine may be used in smaller amounts (0.2% on pulp) than sulfamic acid (0.5% on pulp) while achieving similar viscosity protection.

In one embodiment this invention is a process for maintaining pulp viscosity while enhancing brightness during the bleaching stages of pulp preparation in paper manufacture comprising adding an effective amount of a compound selected from the group consisting of caffeine and guanine to paper pulp prior to or during the bleaching stages of pulp preparation.

In another embodiment, this invention is a process for enhancing brightness and maintaining pulp viscosity during the bleaching stages of pulp preparation in paper manufacture comprising adding up to 2 parts by weight caffeine or guanine to 100 parts by weight dry paper pulp.

In a preferred embodiment, this invention is a process for enhancing brightness and maintaining pulp viscosity during the bleaching stage or stages in paper manufacture comprising adding about 0.20 parts by weight caffeine or guanine to 100 parts by weight dry paper pulp.

The following example illustrates the use of caffeine and guanine as replacements for sulfamic acid as a viscosity stabilizer.

EXAMPLE 1

Caffeine and Guanine as Viscosity Stabilizers in the Bleaching Stage of Pulp Preparation Unbleached kraft process spruce pulp having a Kappa number of 38.7 was treated with sulfamic acid, caffeine or guanine at different percentages on pulp while the pulp was bleached in a typical bleaching procedure. The single capital letters C, E, D, are used to describe particular bleaching stages as described in Casey, *Pulp and Paper Chemistry and Chemical Technology,* John Wiley and Sons, 1980, page 669. The removal of lignin during the bleaching stage is expressed as a reduction in the Kappa number. The pulp properties are measured according to standard TAPPI methods (Technical Association of the Pulp and Paper Industry).

| | TAPPI number |
|---|---|
| Kappa Number | T236 os-76 |
| Viscosity (Cp) | T230 os-76 |
| Brightness Percent | T452 os-77 |

The delignification/bleaching stages were accomplished as follows: Protective agents were added at the indicated percentages on pulp and chlorination with chlorine water (C stage) was at 9.66% chlorine on pulp at room temperature for one hour at 3% pulp consistency.

Caustic extraction with sodium hydroxide NaOH (E stage) was done at 4% NaOH on pulp at 70° C. for one hour at 12% pulp consistency. Chlorine dioxide bleaching with $ClO_2$ (D stage) was at 1.5% $ClO_2$ on pulp at 70° C. for 2.5 hours at 12% pulp consistency.

Table 1 presents the pulp properties after C, E and D stages when the various protective agents were added to kraft process pulp as viscosity protectors in the chlorination stage. About 0.2% caffeine or guanine protects the viscosity after C and E stages to about the same extent that 0.50% sulfamic acid protects the viscosity.

TABLE 1

| Effect of guanine & caffeine as viscosity stabilizers in bleaching. | | |
|---|---|---|
| | Pulp Properties (C-E-D) | |
| Additives | Brightness % | Viscosity (Cp) |
| None | 72.5 | 16.7 |
| Sulfamic Acid (0.5% on pulp) | 71.3 | 23.7 |
| Guanine (0.2%) | 72.0 | 24.9 |
| Caffeine (0.2%) | 72.0 | 24.5 |

I claim:

1. A process for bleaching paper pulp comprising: adding a compound selected from the group consisting of caffeine and guanine to paper pulp prior to or during at least one stage of a chlorine bleaching sequence wherein the melamine added is in an amount effective to maintain the pulp viscosity while enhancing brightness during said at least one bleach stage.

2. The process of claim 1, wherein up to 2 parts by weight of said compound are added to 100 parts by weight dry paper pulp.

3. The process of claim 2 wherein about 0.20 parts by weight of said compound are added to 100 parts by weight dry paper pulp.

4. The process of claim 1 wherein said paper pulp is digested in a chemical process selected from the group consisting of the sulfate process, the sulfite process and the soda process prior to said bleaching stage.

5. The process of claim 1 wherein said compound is added during a chlorine bleaching stage.

6. The process of claim 1 wherein said compound is added to a hypochlorite bleaching stage.

* * * * *

UNITED STATES PATENT AND TRADEMARK OFFICE

CERTIFICATE OF CORRECTION

PATENT NO. : 4,484,980

DATED : Nov. 27, 1984

INVENTOR(S) : G. Graham Allan

It is certified that error appears in the above-identified patent and that said Letters Patent are hereby corrected as shown below:

Col. 3, Line 19: "the melamine" should be corrected to "said compound".

Signed and Sealed this

*Fifteenth* Day of *October 1985*

[SEAL]

*Attest:*

DONALD J. QUIGG

*Attesting Officer*

*Commissioner of Patents and Trademarks—Designate*